United States Patent [19]

Kümmel

[11] Patent Number: 4,457,695

[45] Date of Patent: Jul. 3, 1984

[54] BURNER FOR THE COMBUSTION OF POWDERY FUELS

[76] Inventor: Joachim Kümmel, Türkisweg 4, D-4044 Kaarst, Fed. Rep. of Germany

[21] Appl. No.: 346,158

[22] Filed: Feb. 5, 1982

[30] Foreign Application Priority Data

Feb. 6, 1981 [DE] Fed. Rep. of Germany ..... 3104054
Oct. 8, 1981 [EP] European Pat. Off. ..... 81108054.8

[51] Int. Cl.[3] ..... F23D 11/04

[52] U.S. Cl. ..... 431/168; 431/1; 431/187; 110/264; 239/214.19; 239/224

[58] Field of Search ..... 431/168, 182, 183, 185, 431/187, 169; 110/261, 263, 264, 265, 347; 239/214.19, 224, 214.11, 214.15

[56] References Cited

U.S. PATENT DOCUMENTS

| | | | |
|---|---|---|---|
| 1,728,011 | 9/1929 | Simmons et al. | 239/214.11 |
| 1,887,015 | 11/1932 | Green et al. | 431/185 |
| 2,341,682 | 2/1944 | Andrews | 431/183 |
| 2,457,067 | 12/1948 | Perretti | 239/214.19 |
| 4,113,416 | 9/1978 | Kataoka et al. | 431/168 |
| 4,113,421 | 9/1978 | Miyahara | 431/168 |
| 4,150,631 | 4/1979 | Frey | 110/186 |
| 4,206,712 | 6/1980 | Vatsky | 431/183 |
| 4,270,698 | 6/1981 | Bisa et al. | 239/171 |

FOREIGN PATENT DOCUMENTS

| | | | |
|---|---|---|---|
| 0007894 | 2/1980 | European Pat. Off. | 431/168 |
| 672311 | 2/1939 | Fed. Rep. of Germany . | |
| 1145736 | 10/1963 | Fed. Rep. of Germany . | |
| 1551936 | 3/1970 | Fed. Rep. of Germany . | |
| 2729476 | 1/1979 | Fed. Rep. of Germany . | |
| 187974 | 3/1937 | Switzerland . | |

*Primary Examiner*—Samuel Scott
*Assistant Examiner*—Allen J. Flanigan
*Attorney, Agent, or Firm*—Shlesinger, Arkwright, Garvey & Fado

[57] ABSTRACT

A burner (1,29) for the combustion of powdery fuels, in particular coal-dust, comprises a central duct (9,37) to supply a jet of core-air (13,41), a fuel channel (12,40) to supply the fuel and a casing channel (5,6; 31) to supply secondary air (7,8; 36).

In order to make such a burner (1,29) also suitable for lesser power ranges, a widened range of regulation and less sensitive to a wide coal-dust band, the discharge means of the fuel channel (12,40) is designed as an annular nozzle (23,53) of which at least one of the two circumferential walls (19,47) is rotatable and driven, and the discharge means of the central duct (13,41) being so designed that the jet of core-air (13,41) is directed at least in part outwardly against the discharging fuel for the purpose of deflection into the region of the secondary air (7,8; 36).

13 Claims, 2 Drawing Figures

BURNER FOR THE COMBUSTION OF POWDERY FUELS

Figure 1:
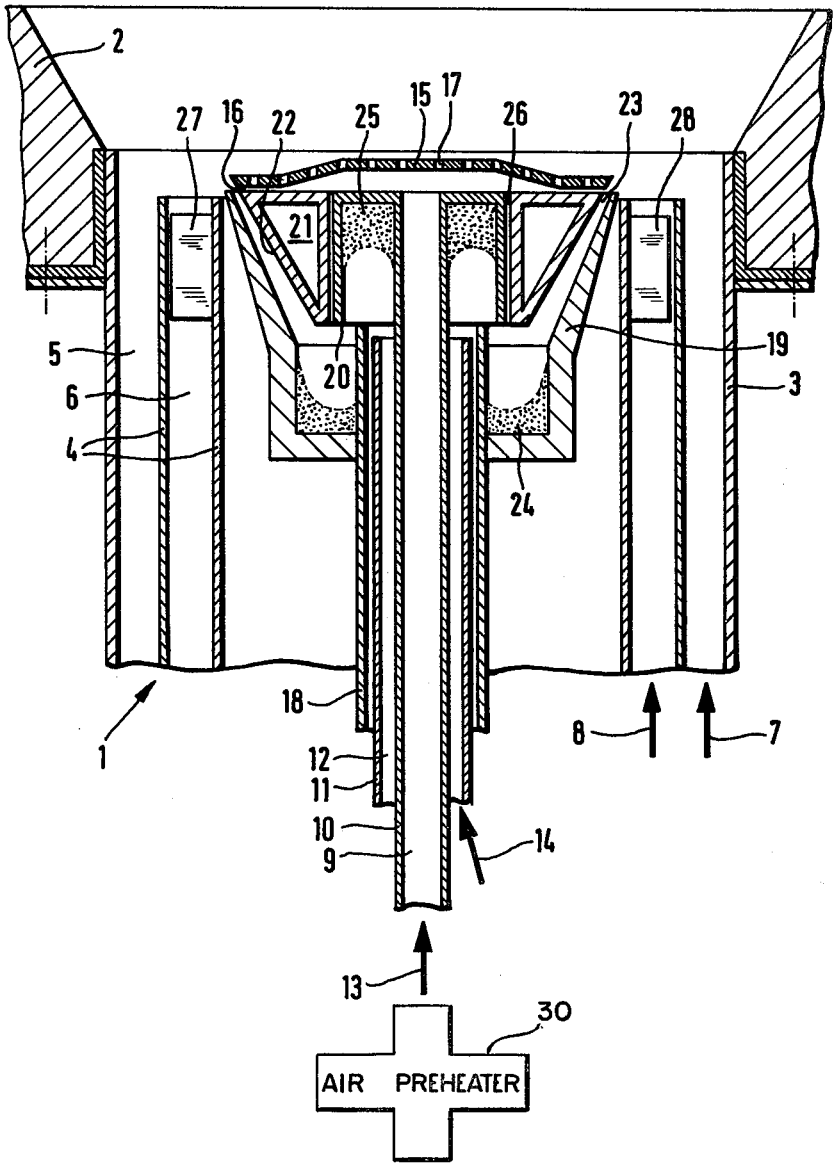

The invention concerns a burner for the combustion of powdery fuels, in particular coal dust, comprising a central duct to supply the jet of core-air, a fuel channel to supply the fuel, and a casting channel to supply secondary air.

So-called coal-dust burners are used for the combustion of coal dust in boiler and hot water plants, said burners being supplied with coal dust by means of a carrier air or carrier gas. The air of combustion flows in part through a central core-air duct in the form of a core-air jet and as secondary air through a casing channel to arrive in the combustion chamber. As a rule a separate pilot burner is used for ignition.

The known coal-dust burners suffer from various drawbacks. They are suitable only for large power units exceeding about 5 Gcal/h in heat output per burner used. Also limits must be placed on the coal-dust/-granularity spectrum to prevent the back travel or the departure of the flame from the burner root. Otherwise there would be the danger of slagging the burner or of flame oscillations or combustion chamber vibrations. Besides, in view of the problems of distribution and backfiring of the known burners, the range of regulation is narrow and is between 50 and 100%. The range of regulation can be widened only in large plants with multiple-burner operation by shutting down individual burners.

It is the object of the invention to so design a burner of the initially cited kind that it shall also be suitable for small ranges of power, that it evinces an enlarged range of regulation and be insensitive with respect to a wide band of coal dust and accordingly can be used together with mixed-bed dust from large central pulverizing plants.

This problem is solved by the invention in that the exhaust of the fuel channel is designed as an annular nozzle of which at least one of the two peripheral walls is rotatable and driven, and in that the exhaust of the central duct is so designed that the core-air jet is directed at least partly outward against the discharging fuel for the purpose of deflection into the area of the secondary air.

The burner of the invention is particularly suitable for a power level clearly less than 5 Gcal/H, mostly for the power range between 0.3 and 3.5 Gcal/h. Accordingly this new burner opens up a new power range for powdery fuels, in particular coal dust.

Because contrary to larger burners the flame volume of burners operating in the above cited power range is correspondingly slight, the coal dust perforce is discharged at a low speed which appropriately is between 3 and 8 m/s. Especially for partial load, this corresponds to the flame-backfire speed. However backfiring is prevented by the rotating part of the annular nozzle, because so high a heat transfer to the coal dust is accomplished thereby that this coal dust acts like a flame filter. Tangential speed of 12 to 30 m/s were found adequate and appropriate for the rotating part(s).

Another advantage of the burner of the invention is in the widening of the range of regulation which henceforth is about 25 to 100%. Again the burner is substantially less sensitive to a wide coal-dust band, whereby also mixed-bed dust can be used. The fine and the finest parts of the dust are discharged with the carrier air from the annular nozzle, while the larger grains are discharged by the rotation of the pertinent part of the annular nozzle.

The latter condition especially applies when the outer peripheral wal of the annular nozzle is supported in rotating manner because in such an instance the larger grains are distributed outward due to the centrifugal forces acting on them. The gliding to the exhaust is facilitated by the flaring conicity of the diameter of the annular nozzle. This conical flaring should be equal to and preferably less that the angle of repose of the particular fuel to avoid erosions and agglomerations.

The fuel channel should assume a cross-sectional S shape in the region of the annular nozzle. The total cross-section in the region of the S contour first should widen and then constrict again toward the annular nozzle. This step makes the fuel flow more uniform along the periphery.

Another feature of the invention provides that the central duct issues near a shielding plate so as to form an annular gap before the exhaust of the annular nozzle. As this shielding plate is very hot on account of the temperatures in the combustion chamber, the core air can be thus heated at this plate and the ignition initiation is thus supported. Moreover this plate implements in a simple manner a deflection in the radial direction for the fuel exhaust at the annular gap. Appropriately the core air should be discharged from the annular gap at a rate of about 20 to 100 m/s to achieve intensive mixing with the discharging fuel and a deflection into the secondary air flow which also contributes to mixing. The mixing performance obtained from the three intersecting mixing surges is substantially load-independent. Additionally the jet of core air forms a backfire shield which is also load-independent as a safety measure against fire in the bowl.

To prevent slagging of the shielding plate, a plurality of small bores are provided through which a slight proportion of the core-air may discharge. Near the rims, these bores may be arranged at angles in order to compensate the decreasing air pressure in the region of the discharge from the annular gap.

Additionally, gap nozzles may start from the central duct, in particular in the area of the annular gap, which issue into the fuel channel, possibly into the middle of its S-shaped region. Thereby the flow of fuel dust is made more uniform before entering the annular nozzle.

If the temperature of the jet of core-air is inadequate to initiate ignition of the fuel, a corresponding pre-heating should be provided. This can be implemented for instance using an electric heat exchanger of which the electrical power supply does not exceed 2% of the burner output even when low-volatile coal is used as the fuel. This corresponds to the proportion of the core-air, which is fairly low in this case, and which provides appropriately from 10 to 15% of the total quantity of combustion air. Additional stabilization of ignition can be further achieved by mixing the core air with steam. This steam accelerates the fuel gasification to such an extent that lower temperatures suffice for preheating, and accordingly the required heat for this purpose can also be reduced.

Vibration generators can be provided in the central duct and/or in the casing channel for the purpose of improving the ignition stability of the mixture of air and fuel dust, whereby the core-air and/or secondary air are set into gas dynamic vibrations before being discharged. These vibration generations can be designed to be the particular annular chambers enclosing the particular channel with which they communicate through an adjusted annular gap. Other designs for imparting a gas-dynamic vibration also are feasible.

Additionally guide-vanes to impart a spin can be mounted at the exhaust of the casing channel. Such a spin contributes to intensifying the outer and inner hot-gas recirculation and thereby enhances the supply of ignition energy. As a consequence the need for preheating the core-air is again reduced.

In order to decrease the thermal influence of the core-air, which especially where fuel with low contents in volatile components is used, will be relatively highly preheated, the invention provides an intermediate channel between the fuel channel and the casing channel. This intermediate channel can be loaded with coolant air during ordinary burner operation and with ignition gas during start-up, and this is at a throughput adequate for the burner heat output related to the particular fuel used.

The drawing illustrates the invention in relation to two embodiments.

Figure 2:
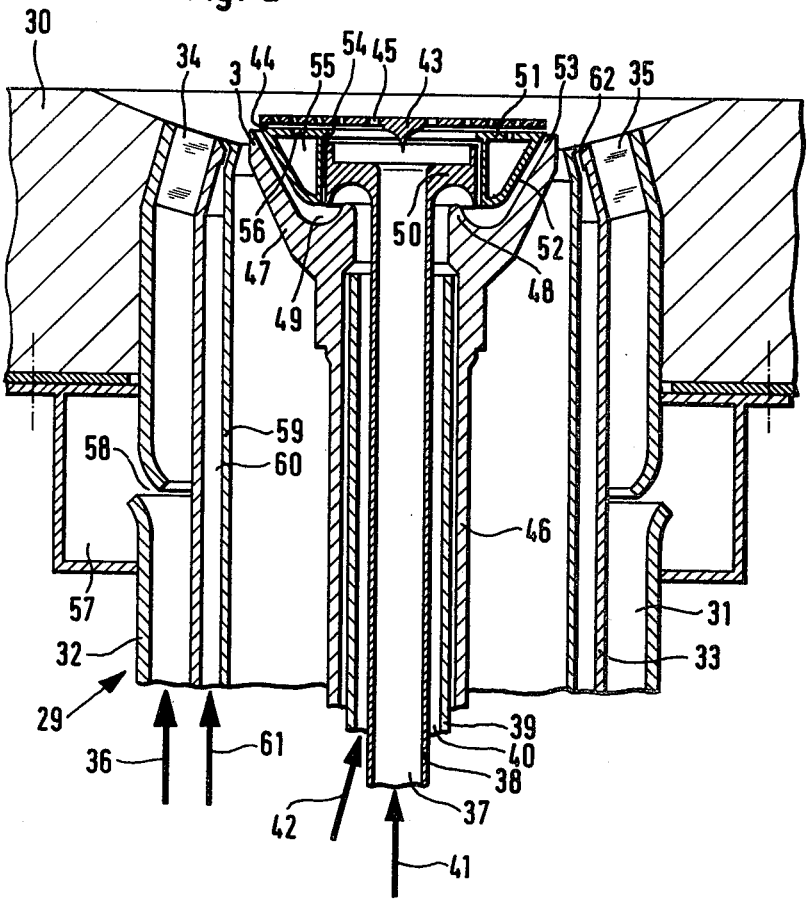

FIG. 1 is a longitudinal section through the upper part of a coal dust burner, shown schematically, and FIG. 2 is a schematic longitudinal section through the upper part of another embodiment of a coal-dust burner.

The coal-dust burner 1 shown in FIG. 1 is mounted as a whole into a conically widening burner sleeve 2. This burner comprises a casing 3 with a casing pipe 4 mounted at a spacing from it. In this manner two casing channels 5,6 are formed through which the secondary air 7,8 can flow into the combustion chamber which in this representation is at the top of this arrangement.

A central pipe 10 enclosing a central duct 9 is mounted coaxially with the casing 3 and the casing pipe 4 together with a fuel pipe 11 which encloses the central pipe 10 so as to form an annular fuel channel 12. Core-air 13, heated as needed, is conveyed through the central channel 9, and a mixture of air and coal-dust 14 is conveyed through the fuel channel 12.

The central pipe 10 terminates at a spacing from a shielding plate 15 which on one hand acts as protection against the heat from the flame and the recirculation and which on the other hand redirects the jet of core air 13 radially outward. The core air 13 discharges lateraly from an annular gap 16.

The shielding plate 15 comprises a plurality of small bores 17 permitting a slight proportion of the core air 13 to discharge through them. In this manner the slag particles reaching this location during the recirculation are cooled enough that they cannot attach themselves to the shielding plate 15.

The fuel pipe 11 is surrounded by a drive shaft 18 which, in a manner not shown herein in further detail, is rotatably supported and driven by an electric motor. A bowl 19 of cylindrical shape at its bottom and conically flaring at its top is mounted to the upper part of the drive shaft 18.

The drive shaft 18 continues upward through the mounting the bowl 19. The gap so formed is entered by a collar 20 of the central pipe 10 which is U-shaped at the top and bent over downward. A conical body 21 of which the conical surface 22 forms an annular nozzle 23 with the conically flaring area of the bowl 19, is arranged around this collar 20. At the same time the fuel channel 12 is made to deflect into an S cross-sectional shape by the collar 20 and the conical body 21 as well as the continuation of the fuel pipe 11 and drive shaft 18 respectively. Coal dust settles in the pockets 24,25 of the deflection path, so that the deflection is made from uniform and the pockets 24,25 are protected against corrosion.

A slotted passgeway 26 for a slight proportion of the core-air 13 is preserved between the conical body 21 and the collar 20. This part of the core-air contributes to the capability of the coal dust to discharge at constant density from the annular gap 23.

In the operation of the coal-dust burner 1, coal dust is introduced through the fuel channel 12, its S-shaped deflection path and the annular nozzle 23 into the combustion chamber. Because this coal-dust burner 1 is especially intended for low heat outputs, the exhaust flow speed must be relatively low, for instance between 3 and 8 m/s, as otherwise the flame would detach from the burner and would be carried away. The discharged coal dust is immediately entrained by the core-air issuing from the annular gap 16 at speeds between 20 ad 100 m/s and is forced into the region of the secondary air 7,8 which discharges through the casing channels 5,6. The portion of secondary air 8 discharging from the casing channel 6 receives a spin from the guide vanes 27,28 which supports the inside and outside hot gas recirculation, the burner sleeve 2 stabilizing the flame.

The core-air 13 is heated by core air preheater 30 in such a manner depending on the proportion of volatile components in the coal dust that together with the heat of radiation from the flame and the hot gas recirculation it will initiate ignition. The heating can be implemented by electrical means up to 350° C. The core-air 13 is additionally heated at the shielding plate 15.

The rotating bowl reliably prevents clogging in the S-shaped deflection path and in the annular nozzle 23 on account of the circumferential shear forces. The bowl further ensures adequate heat transfer to the coal dust to prevent backfiring despite the low discharge speed of the coal dust.

FIG. 2 shows another embodiment of a coal-dust burner 29. For the embodiment shown, the burner again is set into a burner sleeve of which the conical structure stabilizes the flame.

This embodiment provides only for one casing channel 31 formed by a casing 32 and a casing pipe 33. Guide vanes 34,35 are provided at the exhaust of the casing channel 31 in order to impart a spin to the secondary air 32 discharging at that location for the purpose of supporting recirculation.

A central pipe 38 surrounding a central duct 37 is mounted coaxially with the casing 32 and the casing pipe 33, and further a fuel pipe 39 which surrounds the central pipe 38 so as to form an annular fuel channel 40. The core-air 41 passes through the central duct 37, and a mixture 42 of air and coal-dust through the fuel channel 40, both entering the combustion chamber.

As in the embodiment shown in FIG. 1, the central pipe 38 terminates at a distance from a shielding plate 43. This shielding plate 43 radially deflects the core air 41 in the external direction, said air then discharging laterally through an annular gap 44.

Again the shielding plate 43 comprises a plurality of small bores 45 through which a slight proportion of the core air 41 can discharge is order to prevent slag deposits.

The fuel pipe 39 is surrounded by a drive shaft 46 which in this instance too is rotatably supported and driven by a electric motor. The upper end of the drive shaft 46 is designed as a bowl 47 flaring conically outward and comprising an inside annular ledge 48 so as to form an annular groove 49.

A U-shaped collar 50 bent downward and attached to the central pipe 38 enters the annular groove 49 from above. A hollow conical body 51 is mounted around this collar 50, the conical surface 52 of said body forming an annular nozzle 53 with the bowl 47. At the same time the fuel channel 40 is cross-sectionally deflected in an S-manner by the collar 50 ad the annular groove 48.

A slotted passageway 54 is preserved between the conical body 51 and the collar 50 for a slight portion of the core air 41. The purpose of this passageway is the same as that of passageway 26 in the embodiment of FIG. 1.

The inside cavity 55 of the conical body 51 communicates by slit nozzles 56 with the annular gap 44. By the principle of the flute, there results a gas-dynamic vibration generator which sets the core air 41 flowing through the annular gap 44 into low-frequency vibrations. Thereby the mixing thrust effect exerted on the discharging coal dust is made more intense and hence the ignition stability is improved. The same purpose is served by a vibration generator for the secondary air 36 consisting of an annular channel 57 around the casing 32 and communicating through a circumferential slotted nozzle 58 with the casing channel 31. In this manner the secondary air 36 also is set into low-frequency vibrations.

An intermediate pipe 59 is mounted between the drive shaft 46 and the casing pipe 32 with which it encloses a cooling channel 60. Said cooling channel can convey coolant air 61 for the purpose of cooling the (omitted) bearings of the drive shaft 46. During start-up, ignition gas in lieu of coolant air 61 is made to pass through and is discharged through the annular aperture 62, where it is ignited.

Besides the effects from the vibration generators and the cooling channel 60, the function of the coal-dust burner 29 shown in FIG. 2 is the same as that of the coal-dust burner 1 of FIG. 1.

I claim:

1. A burner employing core air and secondary air for the combustion of powdery fuels, comprising:

(a) a core air supply duct;

(b) a fuel supply channel mounted about said core air supply duct;

(c) a secondary air supply duct mounted about said fuel supply channel;

(d) a generally frusto-conical bowl mounted about said fuel supply channel and spaced from said secondary air duct;

(e) a generally frusto-conical body mounted to said core air supply duct and spaced from said bowl for forming an annular gap fuel discharge nozzle therewith;

(f) means for rotatably supporting at least one of said bowl and said body;

(g) means connected to said fuel supply channel for directing said powdery fuel therethrough; and, (h) core air redirecting means disposed adjacent the outlet of said nozzle and said body and forming an annular gap with said body for radially outwardly directing core air through said gap into fuel issuing from said nozzle outlet for directing said fuel into a secondary air stream issuing from said secondary air supply duct.

2. A burner as defined in claim 1, wherein:

(a) said nozzle outlet being sized a distance sufficient to permit said fuel to be discharged at speeds between three and 8 m/s.

3. A burner as defined in claims 1 or 2, including means for rotatably supporting and driving said bowl.

4. A burner as defined in claim 1, wherein:

(a) said annular gap fuel discharge nozzle has a conically flaring diameter.

5. A burner as defined in claim 1, wherein:

(a) said means connected to said fuel supply channel for directing powdery fuel therethrough is an S-shaped channel.

6. A burner as defined in claim 1, wherein:

(a) said core air redirecting means comprises a shielding plate, and said core air supply duct terminates adjacent said shielding plate.

7. A burner as defined in claim 6, wherein:

(a) said shielding plate includes a plurality of bores for providing a discharge outlet for a portion of said core air.

8. A burner as defined in claim 1, wherein said body includes:

(a) gap nozzles extending from said annular gap through said body into the interior of said bowl.

9. A burner as defined in claim 1, further comprising:

(a) core air heating means adapted to preheat said core air to a temperature sufficient to achieve initial ignition.

10. A burner as defined in claim 1, wherein:

(a) one of said body and said secondary air duct is provided with means for generating sonic vibrations comprising an enclosed annular space surrounding one of said fuel supply channel and said secondary air supply duct, and a circumferential slit communicating one of said annular gap and said secondary air supply duct with said enclosed space.

11. A burner as defined in claim 10, further comprising:

(a) an intermediate channel disposed between said fuel supply channel and said secondary air supply duct for supplying coolant air.

12. A burner as defined in claim 10, further comprising:

(a) an intermediate channel disposed between said fuel supply channel and said secondary air supply duct for supplying heating gas.

13. A burner as defined in claim 1, further comprising:

(a) guide vanes associate with said secondary air supply duct for imparting a spin to secondary air discharging from said secondary air supply duct.

* * * * *